United States Patent [19]

Fehling

[11] 4,220,268

[45] Sep. 2, 1980

[54] SELF SUPPORTING REFRACTORY SLIDING PLATE

[75] Inventor: Hans R. Fehling, Geneva, Switzerland

[73] Assignee: Didier-Werke AG, Wiesbaden, Fed. Rep. of Germany

[21] Appl. No.: 899,401

[22] Filed: Apr. 24, 1978

[30] Foreign Application Priority Data

Apr. 27, 1977 [DE] Fed. Rep. of Germany ..... 2718701

[51] Int. Cl.[2] ..... B22D 41/08

[52] U.S. Cl. ..... 222/600; 251/326

[58] Field of Search ..... 222/559, 561, 600, 591; 106/58; 251/326

[56] References Cited

FOREIGN PATENT DOCUMENTS 850627 7/1977 Belgium ..... 222/600

873283 7/1961 United Kingdom ..... 222/591

*Primary Examiner*—David A. Scherbel

*Attorney, Agent, or Firm*—Stevens, Davis, Miller & Mosher

[57] ABSTRACT

There is disclosed a sliding plate for a three plate sliding gate nozzle apparatus comprising a refractory concrete body with metal reinforcement embedded in it and extending out of at least one end a drive connection integral with or engaging the reinforcement whereby the usual external metal frame used to support the plate can be dispensed with.

16 Claims, 10 Drawing Figures

Fig.1
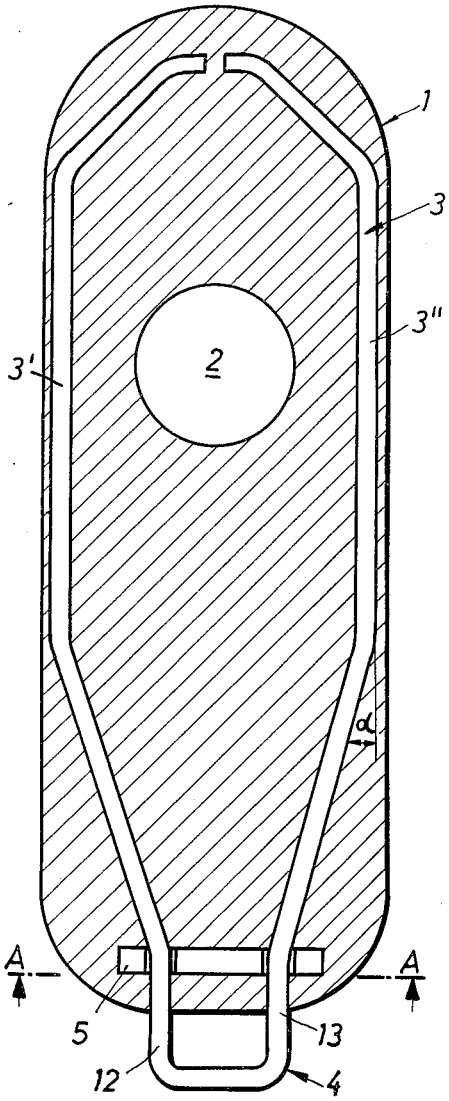
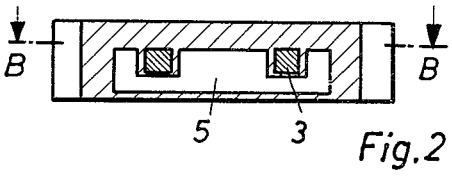
Fig.2
Fig.3
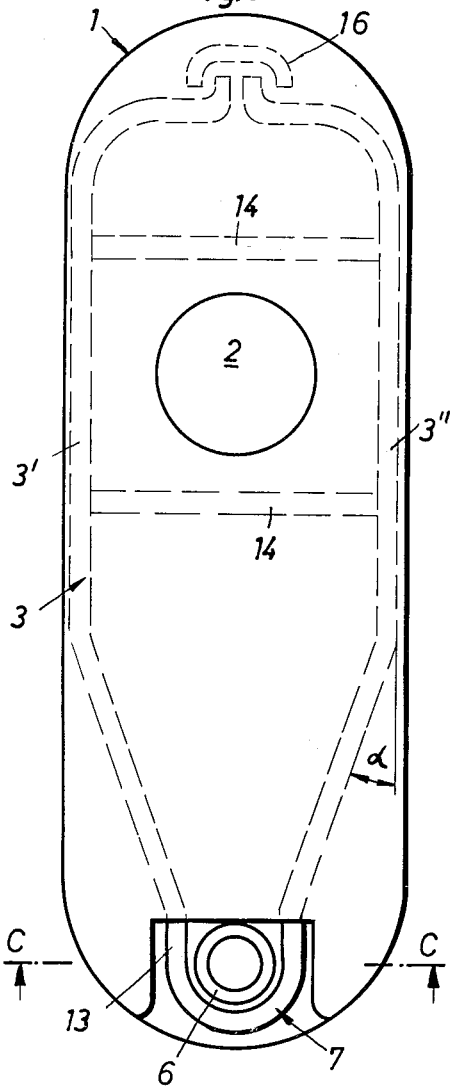
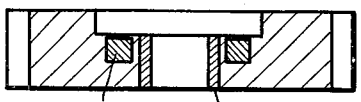
Fig.4

SELF SUPPORTING REFRACTORY SLIDING PLATE

BACKGROUND OF THE INVENTION

This invention relates to self-supporting refractory sliding plates for use in outlet control devices for the outlets of metallurgical vessels such as casting ladles and tundishes for the continuous casting of steel.

The invention relates particularly to sliding plates for so called three-plate sliding gates, in which the movable sliding plate is held between two stationary plates provided with outlet openings.

The invention is described with particular reference to the casting of steel but the refractory wearing parts according to the invention are also applicable to the casting of other metals which cause considerable wear because of their high melting point or their corrosive natue.

Such apparatus comprises a stationary refractory upper plate defining a discharge passage and adapted to be located on the outside of the vessel in juxtaposition to the outlet orifice of the vessel, e.g. by being held in a metal frame attached to the shell of the vessel, and a movable refractory sliding plate defining a discharge passage and mounted for movement between an open position in which the discharge passages of the two plates are in register and a closed position in which the movable plate shuts off the discharge passage of the fixed plate.

Movement of the movable plate can be rotatory through a straight sliding motion is preferred.

In a three plate sliding gate nozzle apparatus the movable plate is mounted for movement between upper and lower fixed plates and is thus substantially parallel faced and the lower fixed plate incorporates or cooperates with an outlet nozzle.

DESCRIPTION OF THE PRIOR ART

Conventional sliding plates consist of refractory plates which in use are cemented into a heavy sliding frame of steel (see, for example, DOS No. 14 58 180 or German Pat. No. 17 43 172).

Unlike static structures in which ceramic parts are installed in metal structures by means of mortar, cement or the like, as is the case, for example, with the linings of furnaces or metallurgical vessels, high dynamic stresses occur in the sliding plates when in operation in a sliding gate nozzle apparatus and result in alternating compression and shear stresses both in the ceramic material and in the mortar due to the thrust of the drive or the reaction thereof caused by the friction between the plate and the surfaces between which it slides. These forces are very considerable and may amount to as much as 15 tonnes thrust in the case of the closing or opening movement of a sliding plate of a length of about 500 mm and a width of about 300 mm.

The sliding plate has to be embedded in the sliding frame in such a way that, on the one hand, the plate and the frame are immovable in relation to one another during operation, when as already stated, very considerable tensile, compression and shear forces have to be absorbed, while on the other hand it must be possible to separate the refractory plate from the sliding frame easily so that a new refractory sliding plate can be fitted rapidly and without difficulty using the old sliding frame. Conventional sliding plates wear very rapidly and this means that new refractory sliding plates have to be installed repeatedly often many times a day. This is a considerable disadvantage.

An attempt has already been made to dispense with the mortar and to insert the refractory plate directly into the gate frame. This, however, gives rise to difficult problems in respect of the fit tolerances for the refractory plates and the sensitivity of the refractory plates to fracture under local heat stresses.

Close production and installation tolerances for sliding gates for metallurgical vessels are very undesirable because the continuous application of the care required to ensure operational reliability and safety is possible only with difficulty in view of the frequent need to replace the rapidly wearing refractory parts. The problem is also aggravated by the inevitable change of shape of the continually heated and then cooled metal parts, particularly if the gate frames are repeatedly used.

SUMMARY OF THE INVENTION

The object of the invention is to provide a self-supporting sliding plate as a pre-fabricated sliding plate unit. This avoids many of the above difficulties and drawbacks because the metal supporting frame can be dispensed with. This enables a worn plate to be replaced rapidly and even by unskilled labour.

Thus, according to the present invention a self-supporting sliding plate for sliding gate nozzle apparatus having at least one outlet opening consists predominantly of refractory concrete having metallic reinforcement embedded immovably at least partially in the concrete and, the reinforcement being connected to at least one coupling member for operation of the sliding plate.

DESCRIPTION OF THE PREFERRED EMBODIMENTS

The use of the self-supporting sliding plate according to the invention avoids many of the above difficulties. There are no special tolerance problems in production. Installation of the refractory plate in a metal supporting frame is completely dispensed with since such a frame does not have to be used. The forces are transmitted from the metallic reinforcement to the ceramic plate extremely well and the transmission can be predetermined and calculated. The embedded metallic reinforcement is very simple and inexpensive to produce in comparison with the known heavy supporting frames used conventionally.

According to one embodiment of the invention, the reinforcement comprises steel rods which are disposed in the plate adjacent its edges and which preferably substantially follow the configuration of the said edge of the plate.

Since the reinforcement need not be made longer than the refractory plate itself, it is sufficient to use standard structural steel. Also, the reinforcement parts, e.g. the steel rods, are not exposed but are embedded substantially (preferably completely) in the refractory concrete, where they are effectively protected against direct heating by convection or radiation. The coupling parts connected to the reinforcement can also be substantially embedded in the refractory concrete.

The coupling parts may be connected to the reinforcement by being integral with the reinforcement or by being attached to it e.g. by welding or by merely engaging the reinforcement in a way such as to transmit the drive forces directly to the reinforcement.

The rods may have any desired cross-section, e.g. a circular cross-section or alternatively an angular cross-section, e.g. square or rectangular.

The reinforcement parts may also be hollow sections or sections which vary over their length, e.g. lugs may be welded over the length of a steel strip in order to improve anchoring.

The reinforcement may also consist of bunches of rods or wires or, if desired cables.

A particular advantage of the use of the self-supporting sliding plate according to the invention is that the installation and removal of the wearing refractory plate in the metal supporting frame is dispensed with while in addition pre-fabrication automatically ensures that the number of possible errors in the preparation of the sliding gate nozzle apparatus for further operation is reduced so that operational reliability is greatly increased.

In the self-supporting sliding plate according to the invention the reinforcement takes over the mechanical function of the metal supporting frame in the known sliding gates.

The sliding plate may have a coupling member at one or both ends, such member being connected to the reinforcement. According to a further preferred modification the sliding plate has two outlet openings spaced apart by more than one diameter so that one plate can carry out the services of two plates simply by rotating it through 180°, only a small extra amount of refractory material being required for the purpose.

Additional reinforcing or strengthening parts may co-operate with the main reinforcement in order to prevent adverse tensile stresses or compressive stresses from occurring in the refractory concrete of the sliding plate when the plate is operated.

Cracks may form in the sliding plate due to the inevitable thermal stresses occurring near the outlet openings in view of the sudden local heating, and these cracks usually radiate star-fashion outwards from the outlet openings. The position of the reinforcement prevents these cracks from being propagated to the edge of the sliding plate and then widening. This ensures that during operation there are no difficulties due to the penetration of steel into the sliding plate or through it. The reinforcement may be complemented by strengthening parts and cross-members connected to the reinforcement, the cross-members being disposed particularly on both sides of the outlet openings. These cross-members reduce the risk of cracks propagating in the longitudinal direction of the sliding plate.

The term "refractory concrete" in this context denotes a concrete based on hydraulically setting mixes containing fused alumina cement.

Sliding plates in accordance with the present invention may be made by providing a mould defining a cavity of the shape required for the plate, locating the reinforcement within the desired position in the mould, locating a mould core or cores defining the outlet opening or openings for the plate in the correct position in the mould, preparing a pourable refractory concrete composition, pouring it into the mould, optionally consolidating it by suitable vibration, allowing it to set and cure, removing the cores and removing the plate from the mould and drying the plate and if desired firing it. Alternatively the metallic reinforcement can be located in position after the concrete has been poured. Alternatively the outlet opening can be drilled out with a diamould drill.

DESCRIPTION OF THE DRAWINGS

The invention may be put into practice in various ways and a number of specific embodiments of plate structures in accordance with the invention and examples of refractory compositions suitable for making the structures will be described by way of example to illustrate the invention with reference to the accompanying drawings in which:

FIG. 1 is a horizontal longitudinal section of a sliding plate according to the invention on the line B—B of FIG. 2;

FIG. 2 is a cross-section through the sliding plate shown in FIG. 1 on the line A—A thereof;

FIG. 3 is a plan view of another embodiment of a sliding plate according to the invention;

FIG. 4 is a cross-section through the sliding plate shown in FIG. 3, on the line C—C thereof;

DETAILED DESCRIPTION OF THE INVENTION

Figure 5:
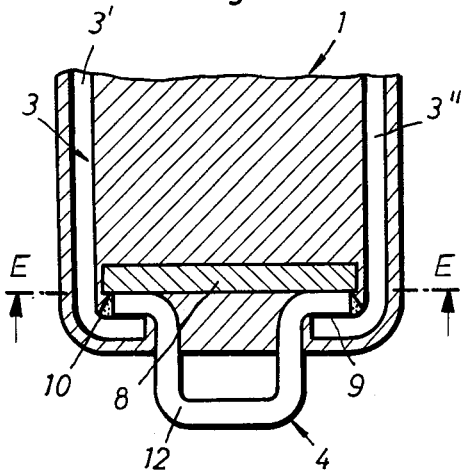
FIG. 5 shows the modified part of a modified form of the reinforced construction of sliding plate shown in FIG. 1 in a horizontal longitudinal section on the line D—D of FIG. 6.
Figure 7:
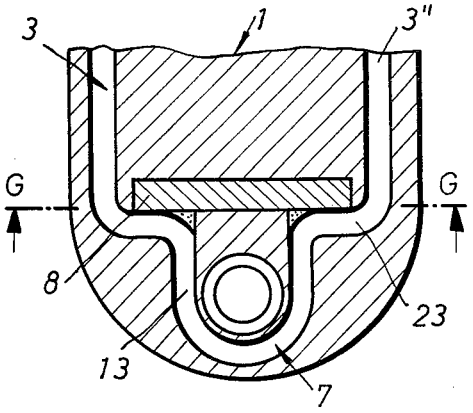
FIG. 7 shows the modified part of a modified form of the reinforced construction of sliding plate shown in FIG. 3 in a longitudinal section on the line F—F of FIG. 8.
Figure 6:
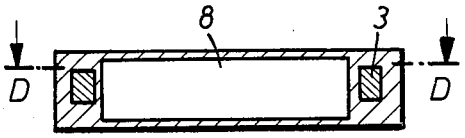
FIG. 6 is a cross-section through the sliding plate shown in FIG. 5 on the line E—E of FIG. 5.
Figure 8:
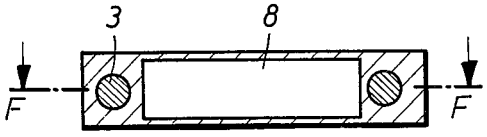
FIG. 8 is a cross-section through the sliding plate shown in FIG. 7 on the line G—G of FIG. 7.

Referring to FIGS. 1 to 8 of the drawings the sliding plate has the reference numerals 1 throughout. The plate is adapted for use as the middle plate of a three plate sliding gate. It has an outlet opening 2 for the molten metal, the said opening being disposed off-centre in the embodiments illustrated. The sliding plate 1 is made from refractory concrete (suitable compositions being described in Examples 1 to 3 below), and has the reinforcement 3 moulded therein. The reinforcement projects out of one end face of the plate 1 to form a coupling member 4, which in this embodiment is thus integral with the reinforcement. The projecting part 4 is so devised that it can be operatively connected by a suitable coupling to an operating rod (not shown) which may, for example, be hydraulically driven.

As can be seen in FIG. 2 the reinforcement is completely embedded in the plate, except for the end portion 4, and does not extend to or through either of the sliding faces of the plate.

The reinforcement 3 incorporates two rod-like portions 3' and 3'' disposed in the edge zone of the plate and substantially following the side edges of the plate at least in the proximity of the outlet opening 2. A reinforcing cross-strut 5 located inwardly of the perimeter of the plate is secured around portions 13 of the steel rods 3' and 3'', which converge at an acute angle $\alpha$ to the periphery of the plate from their locations at the sides of the plate to the portions 13, which extend in parallel relationship and out of the plate to form the coupling member 4. The cross-strut 5 is moulded into the refractory concrete when the plate 1 is produced and serves to avoid impermissible tensile forces at the end face of the plate during the sliding thereof. If required, the cross-strut 5 may be welded to the rods 3' and 3''.

In the embodiment of the sliding plate 1 shown in FIGS. 3 and 4, the coupling member 7, which is made integral with the reinforcement 3, is situated in a cut-out in the plate 1, the parallel portions 13 of the rods 3' and 3'' and the coupling member 7 being located around a steel bush 6 which is immovably embedded in the refractory concrete. In this embodiment of the sliding plate according to the invention the force may be transmitted by means of a pin or mandrel (not shown) which engages the steel bush 6. In the embodiment shown in FIG. 3 an additional anchoring 16 is provided at the end remote from the bush 6. This engages around the ends of the rods 3' and 3'' of the reinforcement 3, which are bent outwardly to extend towards the end of the plate.

In the sliding plate according to FIG. 3, the steel rods 3' and 3'' extending along the longitudinal sides are connected by cross-rods 14 disposed on either side of the outlet opening 2.

Together with the parts of the rods 3' and 3'' lying between the rods 14, the latter help to minimize any propagation and further opening of any cracks which may form at the opening 2 and which would usually radiate star-like from the opening 2.

In certain cases, particularly in the case of large sliding gates, the forces required for operation are very considerable. In such cases it is desirable to strengthen the reinforcement 3 at the end faces where the coupling member is situated. An arrangement for doing this is shown in FIGS. 5 to 8 of the drawings. While high tensile forces can be taken by an appropriate thickening of the cross-section of the reinforcement, the provision of an additional reinforcing element in the form of a cross-rod or cross-plate 8 is advantageous for the transmission of high thrusts. This reinforcing part 8 is advantageously welded to parts of the reinforcement of coupling members 4 as shown at 10 and 11 in FIGS. 5 and 7.

In the embodiment shown in FIG. 5, the coupling member 4 is in the form of a steel stirrup, or U-shaped member having out turned upper ends, 12 which projects from the plate 1 and which is advantageously welded, as shown at 9, to the portions 23 of the rods 3' and 3'', which are bent at right angles.

The embodiment shown in FIG. 7 again has portions 23 which are bent at right angles and which continue into the coupling member 7 embracing the steel bush 6. The coupling member 7 and the steel bush 6 are immovably embedded in the refractory concrete of the sliding plate.

Figure 9:
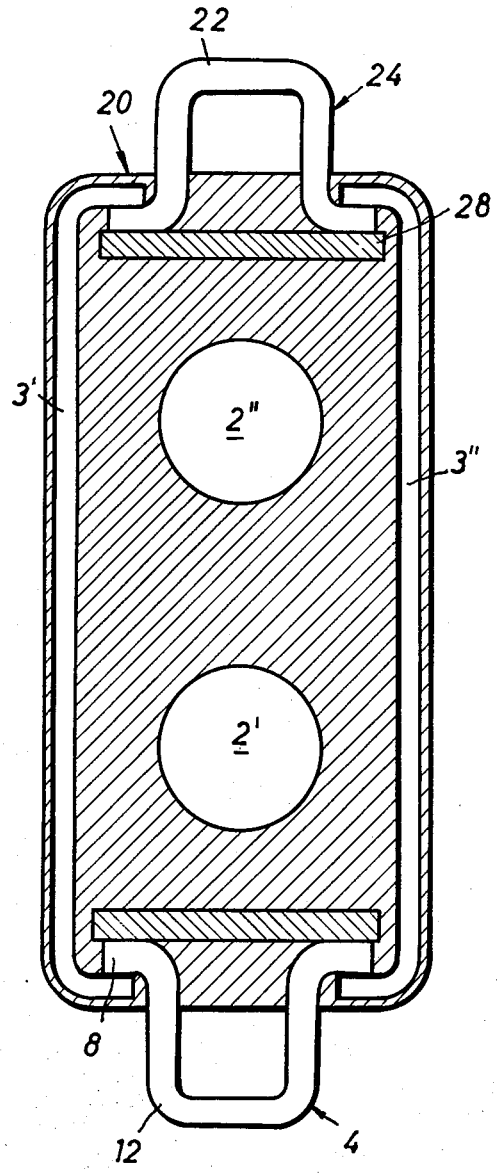
FIG. 9 is a plan view of a sliding plate in accordance with the invention having two outlet openings and two coupling members.
Figure 10:
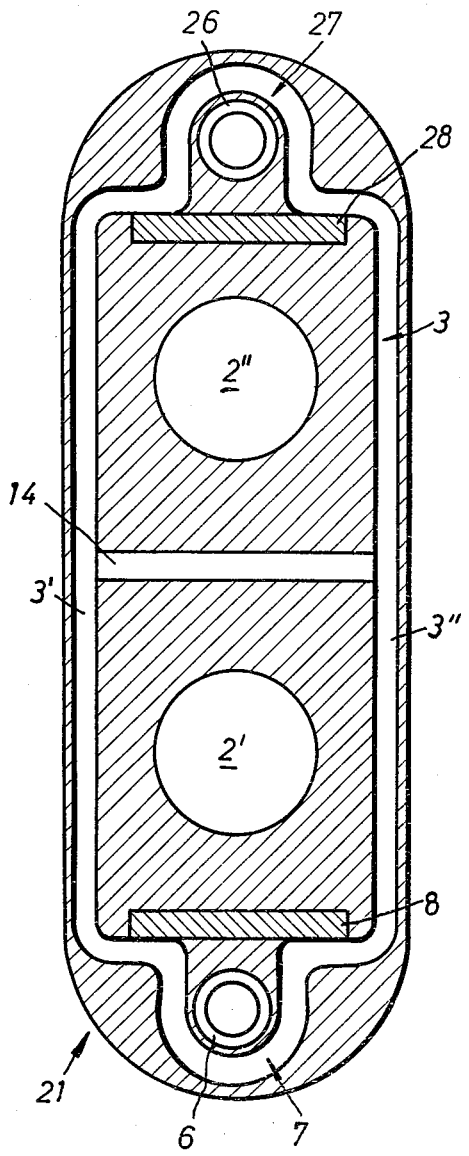
FIG. 10 is a plan view of another embodiment in accordance with the invention having two outlet openings and two coupling members.

FIGS. 9 and 10 show embodiments of the sliding plate according to the invention in which two outlet openings 2' and 2'' are provided and a coupling member is disposed at each end of the sliding plate.

Referring to FIG. 9, two outlet openings 2' and 2'' are disposed substantially symmetrically in the sliding plate 20. The reinforcement 3 consists of two steel rods 3' and 3'' which are connected, at the end faces to coupling members 4 and 24 in the form of steel stirrups or U-shaped members having out turned upper ends, which each provide a loop 12 or 22 projecting out from the plate 20. The coupling members 4 and 24 are welded to the portions 23 and 25 bent at right angles. Reinforcing members in the form of cross-rods or cross-plates 8 and 28 are welded to the inside faces of the ends of the coupling members 4 and 24.

The sliding plate 21 according to FIG. 10 is also provided with two outlet openings 2' and 2'' and has two coupling members 7 and 27 moulded into the refractory concrete of the plate but these are integral with the reinforcement 3. The diameters of the openings 2' and 2'' may differ from one another. Steel bushes 6 and 26 are immovably embedded within the confines of the coupling members 7 and 27 and a pin or mandrel (not shown) may engage these bushes for operation of the sliding plate 21.

Cross-rods or cross-plates 8 and 28 are welded for reinforcing purposes to the right-angled ends 23 and 25 of the portions 3' and 3''. In the middle of the sliding plate 21, a cross-rod 14 is disposed between the rods 3' and 3'' and connected thereto by welding. The cross-rod 14 reinforces the reinforcement 3 and limits any cracks radiating from the outlet openings 2' and 2''.

The sliding plates 20 and 21 can each provide the services of two sliding plates; all that is necessary is to turn the plate through 180° after conventional use of one of the outlet openings, in which case the other outlet opening then comes into use. The rotation through 180° may be carried out either about the vertical axis of the gate or about the horizontal plane of symmetry.

The sliding plate may either consist completely of refractory concrete or may consist of a main part consisting of refractory concrete and provided with the reinforcement, in which main part one or more inserts formed with the outlet openings and consisting, for example, of high-grade material may be located e.g. by being embedded in the refractory concrete during the casting process.

Examples of refractory concretes suitable for the production of sliding plates according to the invention are given below.

EXAMPLE 1

80% by weight of an aggregate containing 40% by weight of $Al_2O_3$ and having a particle size from 0 to 5 mm are mixed with 20% by weight of a fused alumina cement having a content of 40% by weight of $Al_2O_3$, 12 liters of water being added in respect of each 100 kg of the dry mix.

The mix is poured into a mould, and is compacted by vibration should this be desirable. The parts of the metal reinforcement are inserted and the resulting sliding plate is removed from the mould after having sufficiently set, is then stored for curing and dried.

EXAMPLE 2

80% by weight of Guyana bauxite, containing 88% by weight of $Al_2O_3$, and having a particle size of 0 to 5 mm, was mixed with 20% by weight of alumina cement containing 70% by weight of $Al_2O_3$ and 10 liters of water per 100 kg of dry mix.

This mix was further processed as described in Example 1.

If the parts are to be used for casting steel having a melting point above 1500° C. and a pouring temperature 50° to 60° above the melting point, the conditions that the plates have to withstand are very much more severe and in order to ensure a more reliable service, special compositions must be used for such plates.

For such very severe conditions it is preferred to use refractory concretes of substantially the following composition:

5 to 8% by weight of an alumina cement, 2.5 to 4% by weight of at least one pulverulent refractory material (having a particle size of less than 50 microns and preferably less than 1 micron), e.g. kaolin or bentonite, micronised silica, micronised alumina, micronised magnesia, micronised chromite or micronised forsterite, 0.01 to 0.3% by weight of a thinning agent effective to increase the flowability of the composition, comprising an alkali metal phosphate, an alkali metal polyphosphate, an alkali metal carbonate, an alkali metal carboxylate or an alkali metal humate, and from 87.7 to 92% by weight of at least one refractory aggregate, preferably having a particle size not exceeding 30 mm, and desirably all of which pass a 10 mm mesh and about 25% of which pass a 0.5 mm mesh screen. The refractory aggregate may consist of calcined refractory clay, bauxite, cyanite, sillimanite, andalusite, corundum, tabular alumina, silicon carbide, magnesia, chromite or zircon, or mixtures thereof.

The following example is given for such a refractory concrete:

EXAMPLE 3

87.7 to 92% by weight of tabular alumina, particle size 0 to 6 mm, are mixed with 5 to 8% by weight of alumina cement containing about 80% by weight of $Al_2O_3$, 2.4 to 4% by weight of micronised alumina and 0.01 to 0.3% by weight of an alkali metal polyphosphate. 5 liters of water are added per 100 kg of dry mix. The mix is poured into a mould and can be compacted by vibration.

If required, the sliding plate may have inserts of other ceramic material moulded into the refractory concrete. For example, inserts of refactory material such as chamotte or magnesite, may be moulded in for the outlet openings.

What I claim as my invention and desire to secure by Letters Patent is:

1. A self-supporting sliding plate for sliding gate nozzle apparatus having at least one outlet opening and consisting predominantly of refractory concrete, metallic reinforcement at least part of which is embedded immovably in the concrete and at least one coupling member for operation of the sliding plate connected to the reinforcement.

2. A sliding plate as claimed in claim 1 in which the reinforcement comprises first portions which are disposed adjacent the edges of the plate and which substantially follow the side edges of the plate at least in the proximity of the outlet opening.

3. A sliding plate as claimed in claim 2 in which the portions disposed adjacent the edges of the longitudinal sides of the plate extend from adjacent one end to over half way along the plate to the other end.

4. A sliding plate as claimed in claim 3 in which the said portions converge at an acute angle ($\alpha$) towards the coupling member disposed at the said other end of the plate.

5. A sliding plate as claimed in claim 4 in which the reinforcement, after converging from the said first portions have second portions which, near the coupling part, extend in parallel relationship to the longitudinal side edges of the plate.

6. A sliding plate as claimed in claim 5 including a cross-strut which reinforces the said second portions of the reinforcement which extend in parallel relationship near the coupling member.

7. A sliding plate as claimed in claim 6 in which the said cross-strut is a steel strip disposed on edge and having cut-outs accommodating the said second portions of the reinforcements.

8. A sliding plate as claimed in claim 2 in which the first portions of the reinforcement extend along the longitudinal sides of the plate from one end of the plate to the other and are bent at right angles of the end of the plate, said coupling member forming third portions bent at right angles to the said first portions and connected thereto.

9. A sliding plate as claimed in claim 8 including a reinforcing cross-member which connects the said third portions.

10. A sliding plate as claimed in claim 9 in which the coupling member and the reinforcements are made in one piece.

11. A sliding plate as claimed in claim 1 in which the coupling member defines a U-shaped loop projecting out from the end of the plate.

12. A sliding plate as claimed in claim 1 including a steel bush embraced by said coupling member which is immovably embedded in the refractory concrete and around which the reinforcement is passed.

13. A sliding plate as claimed in claim 1 including an anchor member reinforcing the reinforcement at the end of the plate remote from the coupling member.

14. A sliding plate as claimed in claim 1 including a cross-rod in which the said first portions of the reinforcement are connected to said cross-rod which is disposed on the side of the outlet opening disposed towards the midpoint of the plate.

15. A sliding plate as claimed in claim 1 including a second outlet opening, said two outlet openings being positioned distances from the end faces which are substantially the same.

16. A sliding plate as claimed in claim 1 including a coupling member at each end face of said plate.

* * * * *